United States Patent [19]

Kellison

[11] Patent Number: 4,954,009

[45] Date of Patent: Sep. 4, 1990

[54] ROAD BARRIER SYSTEMS AND METHODS

[76] Inventor: Roger C. Kellison, 8200 Boulevard East, North Bergen, N.J. 07047

[21] Appl. No.: 252,517

[22] Filed: Sep. 30, 1988

[51] Int. Cl.[5] ..... E01F 13/00; E01F 15/00

[52] U.S. Cl. ..... 404/6; 256/13.1

[58] Field of Search ..... 404/6, 8, 9, 12, 16; 256/1, 13.1, 19; 52/403, 377, 396; 156/71, 293, 294, 295; 411/908, 910, 377; 106/90; 403/268, 288; 405/261

[56] References Cited

U.S. PATENT DOCUMENTS

| | | | |
|---|---|---|---|
| 2,114,906 | 4/1938 | Nyhagen, Jr. | 52/396 |
| 3,298,272 | 1/1967 | Henderson | 411/910 |
| 3,317,189 | 5/1967 | Rubenstein | 256/13.1 |
| 3,406,946 | 10/1968 | Saultz | 256/19 |
| 3,982,735 | 9/1976 | Fornells | 256/13.1 |
| 4,224,002 | 9/1980 | Heenan et al. | 256/13.1 |
| 4,338,041 | 7/1982 | Schmanski | 256/13.1 |
| 4,356,676 | 11/1982 | Hauptman | 52/403 |
| 4,394,096 | 7/1983 | Stevens | 411/910 |
| 4,406,563 | 9/1983 | Urlberger | 404/6 |
| 4,494,990 | 11/1985 | Harris | 106/98 |
| 4,498,803 | 2/1985 | Quittner | 404/6 |
| 4,502,812 | 3/1985 | Zucker | 404/6 |
| 4,514,125 | 4/1985 | Stol | 156/295 |
| 4,515,499 | 5/1985 | Furiate | 404/6 |
| 4,553,875 | 11/1985 | Casey | 404/6 |
| 4,605,336 | 8/1986 | Slaw, Sr. | 404/6 |
| 4,681,302 | 7/1987 | Thompson | 256/13.1 |
| 4,751,893 | 6/1988 | Brantley | 256/13.1 |
| 4,822,208 | 4/1989 | Ivey | 256/13.1 |

FOREIGN PATENT DOCUMENTS 2228139 11/1974 France .

*Primary Examiner*—Stephen J. Novosad
*Assistant Examiner*—Gay Ann Spahn
*Attorney, Agent, or Firm*—Brumbaugh, Graves, Donohue & Raymond

[57] ABSTRACT

Barrier systems and methods include relatively narrow, cast, silica fume concrete road barriers for work site protection, road edge, and traffic lane divider locations. Reflector-bearing caps close recesses at the location of fasteners securing the barriers to a road surface. Reflectors with mounting portions secured between adjacent end faces of barriers project outward to expose a reflector portion to headlights in an adjoining traffic lane. Barrier extension members affixed atop a line of barriers reduce headlight glare, help prevent vehicles toppling over the barriers, and prevent relative rocking of one barrier with respect to another. Permanent barrier installations include a rope-like soft Butyl rubber seal damming locations where fasteners extend into the road surface to retain a hardening bonding agent and form a liquid and contaminant impervious environment for the fasteners. Drop-in-place barriers with openings extending their entire height locate over supporting uprights previously used for metal strip barrier. And barriers to be located quickly on soft undersurfaces have openings extending their entire height and securing posts driven therethrough.

30 Claims, 5 Drawing Sheets

ROAD BARRIER SYSTEMS AND METHODS

BACKGROUND OF THE INVENTION

This invention relates to cast concrete road barrier systems and methods for their placement and use, and more particularly to improved road barrier systems and methods that result in more secure placement of cast barriers, greater visibility of the barriers, increased height by the use of additions thereto, and particular features for particular applications.

Cast concrete barriers, like the barriers 15 of FIG. 1, protecting a work site 17 along traffic lanes 18 of highways and at road edges are well known. These typically have a broad, flat base and taper upwardly to a more narrow top 30" to 40" above the road surface. They may be temporarily or permanently installed. Often, at or near a shoulder, where the thicker lower portion of the barrier tapers to a narrower upper portion, recesses define locations at which vertical openings from the recesses to the supporting bottom surface can receive fasteners extending through the recesses and into the road surface. Surface water creeping under the barriers can reach the fasteners where they emerge from the barrier and enter the road surface. With time this can cause deterioration of the fasteners and significantly affect the strength of the connection.

Trucks with high centers of gravity can impact barriers presently being used and topple over the barriers into a work site or down an embankment. For this reason, standard barrier heights have gradually risen from 32 to 34 and up to 42". Although some provisions have been suggested to address the problem, barriers that rock as illustrated in FIG. 2 when impacted by a vehicle, as indicated by the unnumbered arrow, can expose the facing end surface 19 of the next barrier in a line so that what starts as a glancing blow ends with direct, head-on impact to result in a much more severe accident. Low metal strip barriers and even the cast concrete barriers currently in use between opposing traffic lanes are often unable to protect against the glare of approaching headlights. Particularly on bridges, high barriers block the view and the make drivers and their passengers feel too narrowly enclosed. Lower barriers, on the other hand, can permit vehicles with higher centers of gravity to topple over them, as mentioned.

Along many roads, low metal strip barriers continue to be used rather than being replaced by higher, less easily broken or damaged, and therefore more secure, cast concrete barriers. Uprights in the form of steel I-beams or wooden posts secure these. Because of flexibility of the metal of the barrier strip, a vehicle impacting the strip at the location of the post can sever or knock down that upright.

BRIEF SUMMARY OF THE INVENTION

In accordance with this invention there is provided barrier systems useful for temporarily protecting work sites and permanently serving at road edges and between traffic lanes. Visibility of these is increased by reflectors adapted to fit the recesses where fasteners enter openings from the barrier shoulder to the road surface. Other reflectors have mounting portions located between juxtaposed end faces of end-to-end series of barriers. In both reflector types, protruding portions bear reflective elements and give good visibility of the barriers thus formed.

Cast concrete barrier extensions securely fastened along the tops of a series of barriers serve the dual purpose of, first, restraining against the toppling over the barriers of vehicles with high centers of gravity and second, interconnecting adjoining barriers to prevent one rocking relative to the other, such as exposes an end surface to an impinging vehicle. These extensions find use with older, already inplace, low barriers as well as new barriers to be installed. An elongate strip reflector and sealing member has a rib extending between the upper surface of the barrier and the barrier extension member secured to its top. An outer reflective surface of this strip contributes to the visibility of the line of barriers. Cast concrete barrier extensions can mount upstanding glare deflectors if additional height is required to prevent glare from the headlights of oncoming traffic.

Hollow plastic barrier extensions can be fit onto a line of barriers to serve as glare deflectors. These can be used alone or can have a cast concrete core molded within. These plastic extensions can be extruded members with skirted bottoms suitable to fit against the sides of barriers to which they are fastened. Internally, brackets are provided that can retain reinforcing rods when the concrete core is cast. These rods can be the means for prestressing the concrete core.

At bridges and other locations, the barrier extension members can be formed as a generally horizontal upper rail portion with integrally cast downwardly projecting supports through which fasteners extend into the upper surface of the line of barriers. This opens the vista to the driver and vehicle occupants, while raising the barrier height and interconnecting end-to-end barriers.

Relocating barriers that temporarily protect a work site, one of several inventive approaches can be chosen. A rope-like seal, impervious to liquid and other contaminants such as gasoline and salt, can be laid in two long parallel lines at the road edge, where the long edges of the barrier undersurfaces will rest. Shorter cross lengths of the seal stretch from one of the parallel lines to the other near the location of each barrier end so that when the barriers are brought to rest on the seals, their undersurfaces are engaged by a rectangle of the rope-like seal segregating the central locations under the barriers where fasteners protrude through the barriers into the road surface. After holes are drilled in the road surface through the openings in the barriers, a hardening securing agent is introduced to fill the holes thus-drilled and to fill as well the sealed location bound by the rope-like seals. Upon hardening, the securing agent, too, is impervious to liquid and other contaminants, and good, continuing protection against the deleterious effects of ground water, salt, etc., is provided for the anchors that extend into the road surface to secure the barriers in place.

Relatively thin barriers now can be cast with strength equal to thicker predecessors. Silica fume concrete allows this and provides good resistance to breaking. Precious lane space is saved where these are temporarily placed dividing lanes or in protective relation to a work site. Similarly a single truckload can contain more of the lighter, narrower barriers.

Where low metal strip barriers are secured by steel or wood uprights, typically a section of I-beam or heavy wooden beam, wide, cast concrete barriers with openings extending their entire height from top to bottom, and spaced appropriately to receive the uprights, can be dropped onto the uprights after the lower, more easily broken or damaged, and less safe metal strip is removed. Because of its rigidity, the concrete barrier distributes force among the uprights securing it, reducing the likelihood of severance of the upright.

Finally, in installations of soft earth adjoining the roadway, barriers with openings through their entire height, from top surface to bottom surface, can be used with long securing posts driven well into the supporting earth or asphalt.

DESCRIPTION OF THE DRAWINGS

The above and further features of the invention will best be understood with respect to the following detailed description of the preferred embodiments taken in conjunction with the accompanying drawings, in which.

DETAILED DESCRIPTION OF THE PREFERRED EMBODIMENTS

Figure 3:
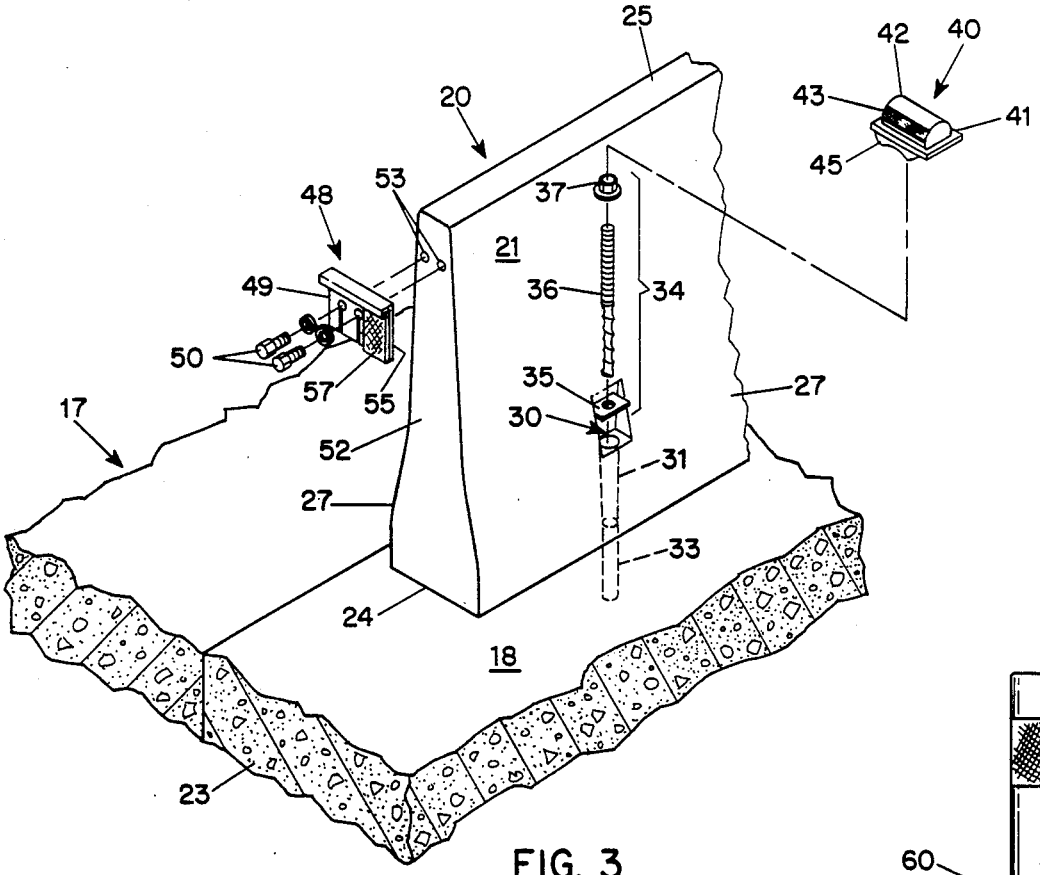
FIG. 3 is a fragmentary perspective view of a barrier system according to the invention and shows reflectors for location at side recesses of the barrier and between opposing end faces of adjacent barriers.

In FIG. 3 a narrow barrier 20 of cast silica fume concrete is more than 30 inches tall, less than 18 inches wide, and has a side surface 21 parallel to the traffic lane 18. It is located to protect the work site 17. A road bed 23 provides the supporting undersurface for the barrier 20. The barrier rests on a broader lower surface 24 and tapers upwardly to a narrower top surface 25. The tapering is more pronounced at shoulders 27 where recesses 30 (one shown) expose mounting holes 31, formed as vertical conical openings to the undersurface 24. Through these are drilled holes 33 in the surface of the road 23. The aligned holes 31 and 33 cooperate with an anchor system 34 that may include a plate or washer 35, anchor 36, like that sold as the "Lefty" of KelkenGold, Inc. of 3005 Hadley Road, South Plainfield, NJ 07080, and nut 37, which may all be removable as set out in the applicant's U.S. Pat. No. 4,642,964. Typically a hardening liquid securing agent like "Kelibond" of KelkenGold, Inc., is poured in sufficient quantity to fill the hole 33 and secure the anchor 36 therein. Used in sufficient quantities and properly installed, anchor systems like the anchor system 34 can secure temporarily installed road barriers, to give good work site protection to personnel and equipment.

Visibility of the line of barriers protecting the work site is improved by a cap 40 that has a widened, substantially flat central portion 41, bearing on its upper surface an upper reflector support 42, in this case a low projection of the same plastic material as the central portion. The upper reflector support bears a reflector 43. A lower projecting portion 45, best seen in FIG. 3*a*, fits the recess 30 of the barrier 20 and secures the cap 40 in place with the reflector 43 facing in the direction of oncoming traffic. The reflector 43 can be a reflective tape or an insert secured on the reflector held by lips 46. The cap 40 improves the visibility of the line of barriers and closes the recess 30. The lower portion 45 is a hollow flexible projection open at its bottom and conforms to the shape of the recess 30. The lower projection is flexible and capable of good frictional engagement with the sides and bottom of the recess 30. A suitable adhesive can be used if necessary to secure the lower projection within the recess. The material of the entire cap is a soft, pliable plastic easily severed, so that, when the temporarily located barrier is to be removed, the flat central portion can be severed to permit access to the nut 37 in the recess.

Another reflector suitable for use with the barriers of FIG. 3 is the relatively flat reflector 48 (FIGS. 3 and 3*c*) that has a mounting portion 49 to be secured by fasteners 52 on an end face 52 of the barrier 20. The fasteners 50 can be any of suitably chosen fasteners capable to secure the reflector 48 by extension into holes 53 provided in the end face for this purpose. A relatively flat projecting portion 55 of the reflector 48 bears a reflective element 57, best seen in FIG. 3*c*. Openings 58 in the mounting portion 49 cooperate with the fasteners 50. An upper lip 59 shields, from the weather, glue securing the reflector 57 to the face of the projecting portion 55. The material of the reflector 48 is a soft pliable plastic, not easily broken. Where the barrier 20 separates opposing traffic lanes, the reflector can include a further projecting portion extending beyond the opposite face of the barrier with a reflective element facing the opposing line of traffic.

Figure 3B:
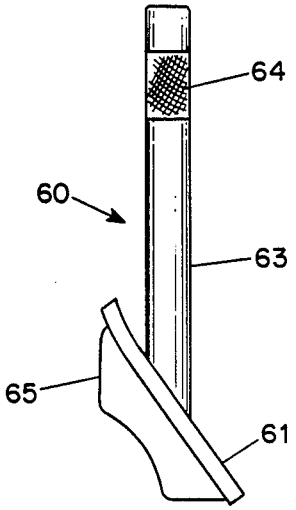
FIG. 3*b* is an enlarged plan view of an alternate recess-mounted reflector for a barrier like that of FIG. 3.
Figure 3A:
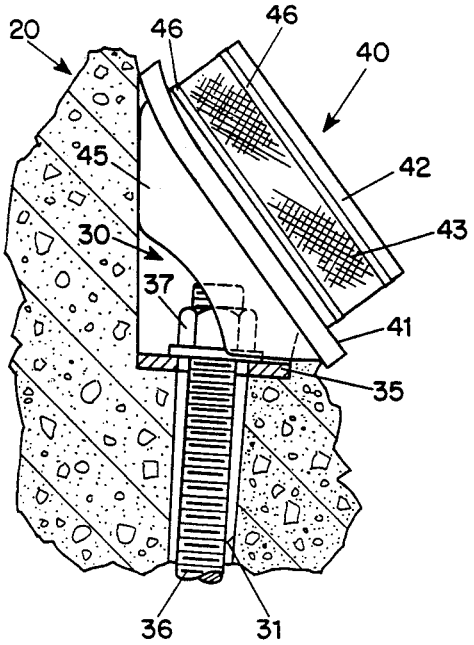
FIG. 3*a* is a fragmentary view, partially in section, of the recess-mounted reflector of FIG. 3 in place on the barrier.
Figure 3C:
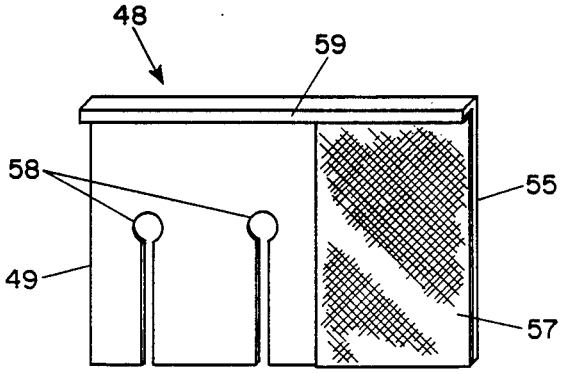
FIG. 3*c* is an enlarged perspective view of the reflector for location between opposed end surfaces of adjacent barriers.

An alternative to the cap 40 of FIGS. 3 and 3*a* is the cap 60 of FIG. 3*b*. A widened substantially flat central portion 61 and a lower projecting portion 65 are like their counterparts in the cap 40 of FIGS. 3 and 3*a*. The reflector support in this case, however, is an upright flexible tubular member 63 on which is supported a reflector 64. Again a reflective tape can provide the reflective portion 64 delineating the line of barriers by reflecting light from approaching headlights at night.

Figure 4A:
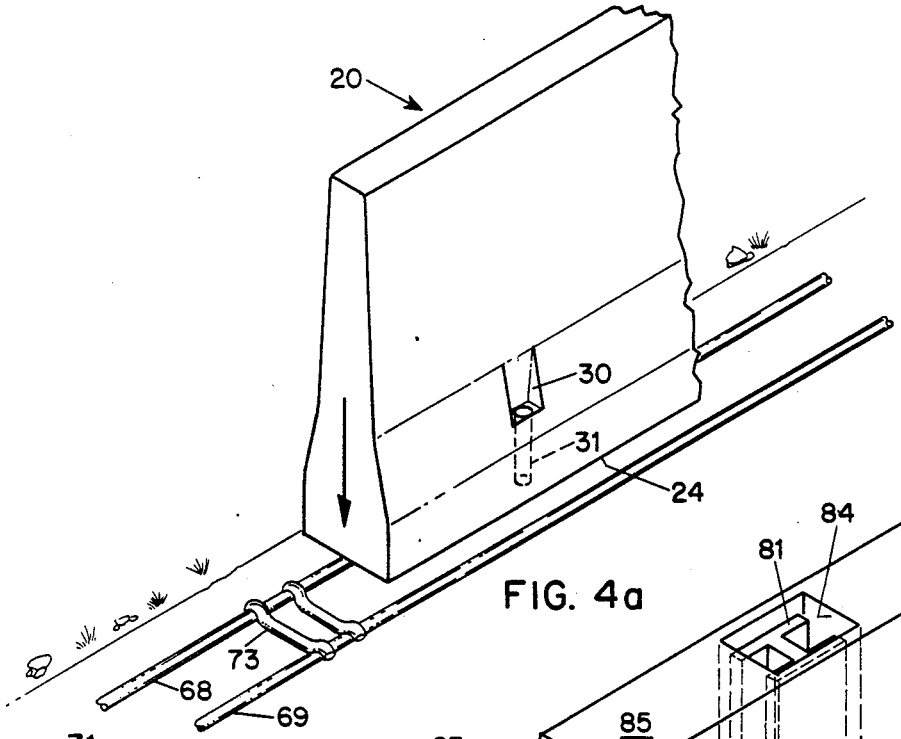
FIG. 4*a* is a fragmentary perspective view of a barrier system using a barrier like that of FIG. 3, and shows rope-like seals to contain hardening securing agent between a road surface and the undersurface of the barrier.
Figure 4B:
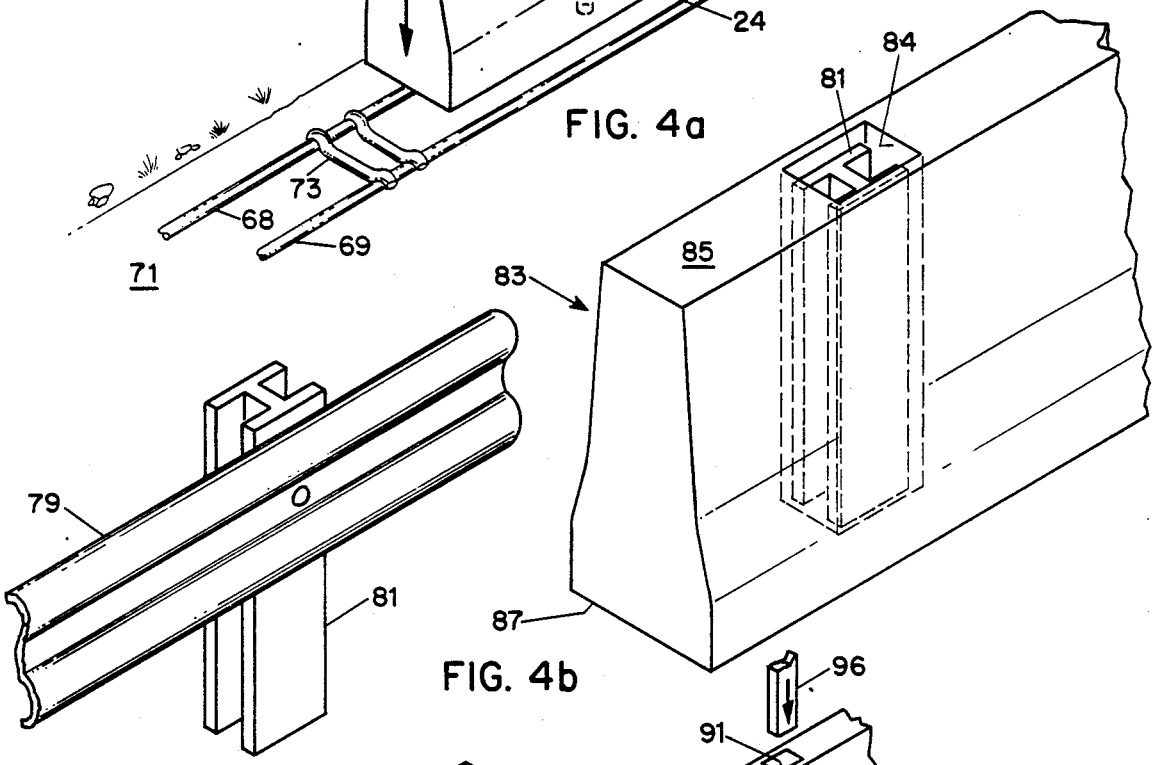
FIG. 4*b* is a further fragmentary perspective view of an alternate embodiment of the barrier of the invention being relocated to replace metal barrier strip.
Figure 4C:
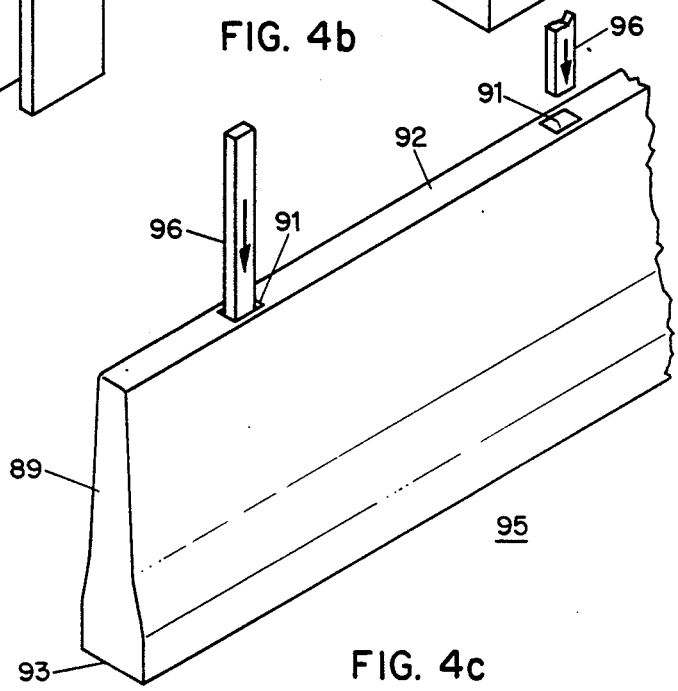
FIG. 4*c* is a fragmentary perspective view of another embodiment of the barrier of the invention for use where soft undersurfaces permit securing posts being driven.

After temporary placement at a work site, the barrier 20 of FIG. 3 can be removed to a permanent installation at the roadside or between opposing traffic lanes. FIGS. 4*a*–4*c* illustrate alternative approaches to locating permanently the barrier 20 or barriers similar to that barrier. In FIG. 4*a* two parallel lines 68 and 69 of a soft, rope-like plastic seal of Butyl rubber or similar material, preferably impervious to liquid and other contaminants such as salt and gasoline, are laid on the road bed 71 where a barrier 20 and others like it are to be dropped into place. The parallel lines 68 and 69 are disposed to contact the undersurface 24 of the barrier near its edges. At each end of the barrier undersurface a cross line 73 is set, from one to the other of the parallel lines. Once the barrier 20 has been dropped into place, as indicated by the unnumbered arrow in FIG. 4*a*, it will be appreciated that nearly all of the undersurface 24 is enclosed in a seal compressed between the barrier and the road surface.

Figure 5:
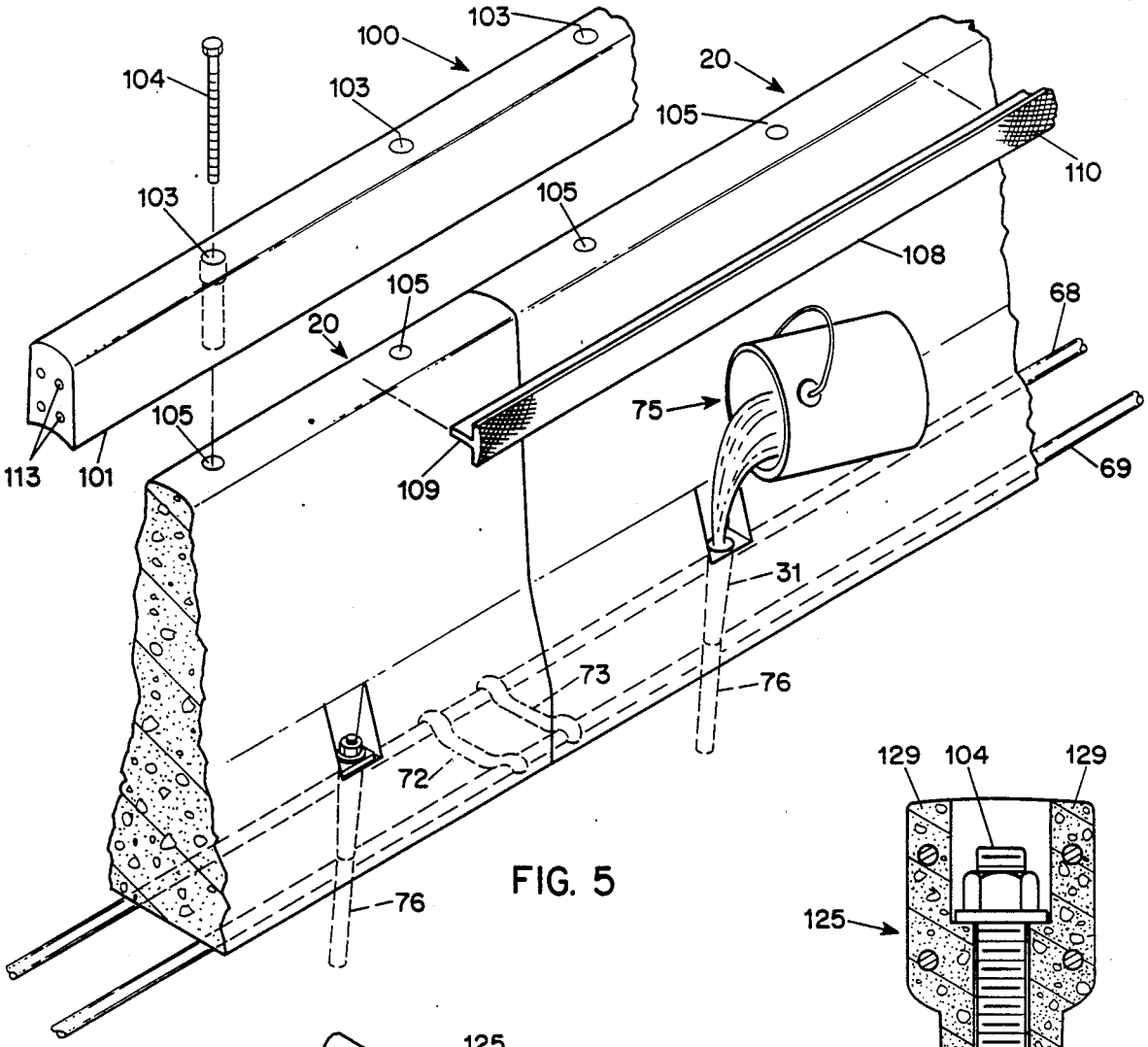
FIG. 5 is another fragmentary perspective view of a barrier system using the rope-like seals of FIG. 4*a* and shows a barrier extension member for attachment to upper barrier surface, and the hardening securing agent and fastener for securing the barriers to the supporting undersurface.

Holes are drilled into the road surface through the vertical openings 31 that open from the recesses 30 to the undersurface 24. As illustrated in FIG. 5, a liquid, hardening bonding or securing agent 75 is introduced through the vertical opening 31 to the hole 76 that has been drilled in the road surface. The hardening liquid fills the holes 76 and all of the surrounding area enclosed by the lines of rope-like seal. Appearance of the liquid bonding agent 75 rising in the vertical opening 31 tells the worker that the appropriate locations have been filled with the agent. Next, an anchor system like the anchor system 34 of FIG. 3 is deployed, extending through the vertical opening 31 into the aligned hole 76. Once hardened, the bonding agent 75 is a further liquid impervious barrier preventing surface waters, as well as spilled oil and gasoline, from reaching the anchor that extends into the road surface.

Turning to FIGS. 4*b* and 4*c*, alternatives to the permanent installation method of FIG. 4*a* are shown. A common installation along many highways is a metal strip barrier 79 typically supported by an upright post, such as a tubular steel post or the I-beam 81 illustrated in FIG. 4*b*. A cast concrete barrier 83 is adapted to replace the metal strip barrier 79. Openings 84 extend from the upper surface 85 to the undersurface 87 of the barrier. These are sized to accommodate uprights such as the tubular steel posts or the I-beams 81 and are spaced appropriately to receive the uprights without relocation of those upright supports. Where the uprights are the I-beams illustrated, the barriers are somewhat thicker than the previously described narrow barriers 20. The barriers 85 are higher than the metal strip barrier 79 and are less easily broken. Because the metal strip barrier 79 is flexible it does not distribute the force of a vehicle impact among several of its supporting uprights when struck at an upright 81. A more rigid barrier 83 does not bend to permit the upright 81 to break, but rather, distributes the force to all of the uprights securing it. Barrier extension members that rest on the upper barrier surface, described below, are a good means for closing the openings 84 that receive the I-beams 81. Spanning several barriers, these can further distribute the force of impact. The replacement thus described provides a higher, much stronger roadside barrier, quickly and inexpensively replacing the metal strip 79.

In FIG. 4*c* a barrier 89 that is narrow like the barrier 20 of FIGS. 3 and 4 has, like the barrier 85, openings 91 that extend from the top surface 92 to the barriers bottom surface 93. This barrier is adapted for use on softer supporting surfaces 95 of earth or asphalt, for example. Securing posts 96 are introduced into the openings 91 and drive into the supporting surface 95 using a small pile driver or the like. Again, the barrier provides a high, strong, quickly placed permanent or temporary barrier. The barriers distribute forces at impact as described above and, again, barrier extension members described below can be secured to the upper surface 92 closing the openings 91.

Figures 1, 2:
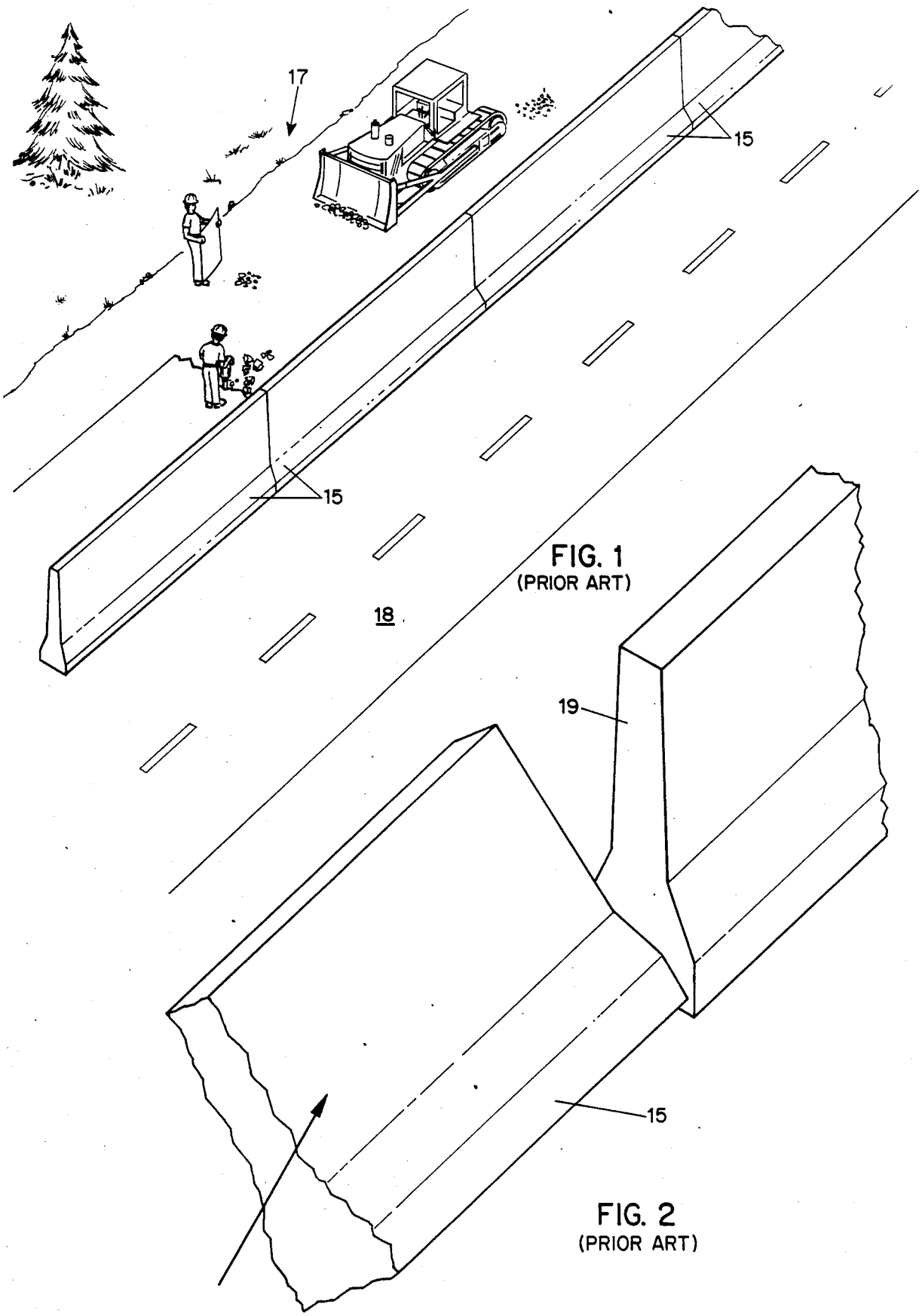
FIG. 1 (PRIOR ART)
FIG. 2 (PRIOR ART)
FIG. 1 is a diagrammatic perspective view of a work site protected by a series of cast concrete barriers of the kind known in the prior art and to which the present invention relates.
FIG. 2 is a fragmentary perspective view of a pair of cast concrete barriers and shows the exposure of the end face of one barrier for head-on impact by a vehicle.

In FIG. 5 a barrier extension member 100 is shown for placement atop a line of the barriers 20. A bottom surface 101 of the barrier extension member conforms to the top surfaces 25 of the barriers 20. Openings 103 along the length of the extension members 100 receive fasteners or anchors 104 that extend therethrough into holes 105 provided in the upper surfaces of the barriers 20. Again, the fasteners or anchors 104 should be secured in the holes 105 by a hardening securing agent. Securely anchored in this manner, the barrier extension member 100 helps restrain vehicles with high centers of gravity from toppling over the barriers.

Where the undersurface of the barrier extension member and the upper surfaces of the barriers come together, an elongate, typically extruded, reflecting seal 108 has a central rib 109 held captive to secure the seal in place. The outer surface 110 of the seal is reflective. The reflective surface can be provided in any number of ways, by tape, paint, or an insert held between lips like those used to secure the reflector 43 of FIGS. 3 and 3*a*. The barrier extension member 100 spans the joint 111 where two adjacent barriers 20 are contiguous. This strong barrier extension element, which can be prestressed concrete as indicated by the ends of bars 113, prevents relative rocking of the barriers 20. With the extension members secured in place, then, the two adjacent barriers will not, under ordinary impact forces, act as illustrated in FIG. 2 to expose an end face of a barrier directly to a vehicle impinging a first of the pair of adjacent barriers.

Figure 6:
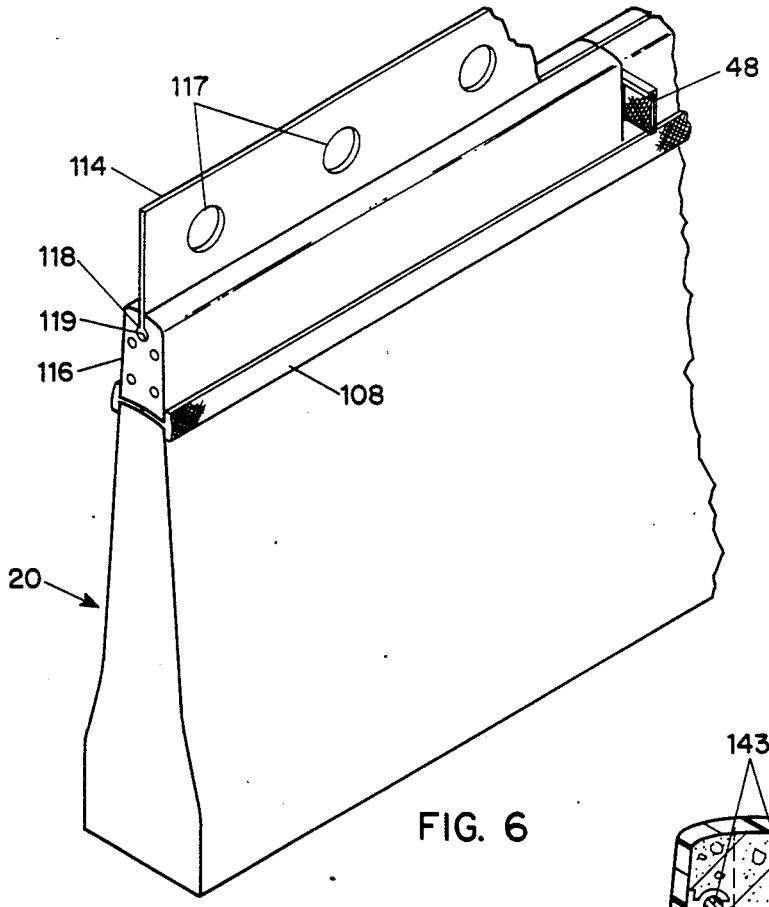
FIG. 6 is a fragmentary perspective view of a barrier system with a barrier extension member that supports a glare prevention screen.

The extension upward provided by the member 100 helps eliminate the glare of oncoming headlights when the barriers and the extension member are used to divide opposing lanes of traffic. In FIG. 6, increased glare protection is provided by a deflector 114 where the height enhancement by the extension member 116, similar to the extension member 100 of FIG. 5, is insufficient for this purpose. The glare deflector 114 is a thin plastic member with wind openings 117 helping to alleviate the pressure applied against it by cross winds. Its bottom is formed as an enlarged bead 118. A conforming channel 119 in the upper surface of the barrier extension member 116 receives the bead captive therein. Good night time visibility of the barrier system of FIG. 6 is provided by the reflective seal member 108, like that described with respect to FIG. 5, and a series of reflectors 48, as described in relation to FIGS. 3 and 3c.

Figure 7:
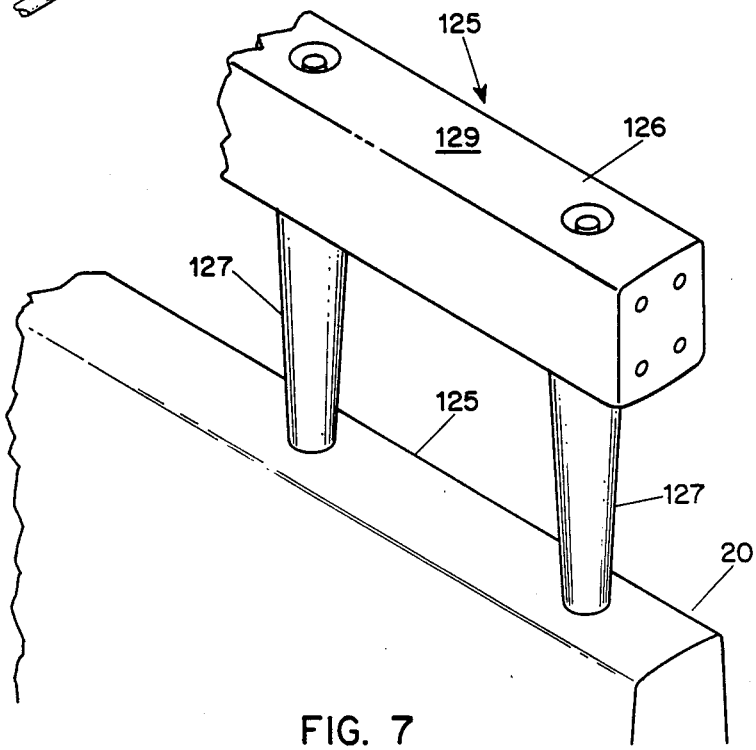
FIG. 7 is a fragmentary perspective view of an alternate barrier extension member, and shows an upper rail and downwardly projecting supports.
Figure 7A:
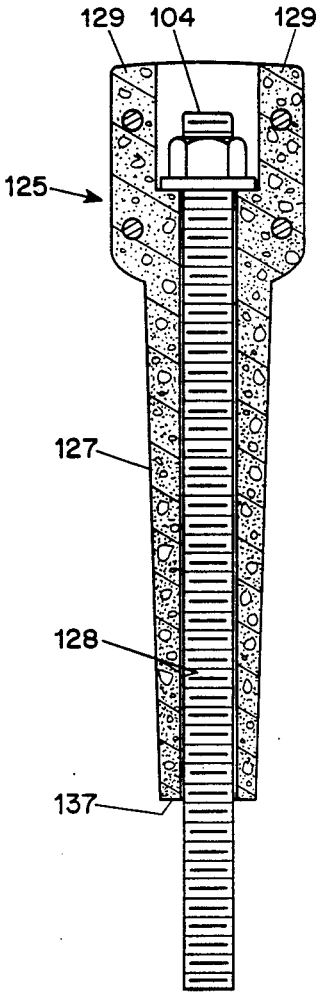
FIG. 7*a* is a cross-sectional view of the barrier extension member of FIG. 7 and shows a fastener extending through the downwardly projecting support.

Other barrier extension member configurations provide specific improvements for particular installations. In FIG. 7, a barrier extension member 125 has a rail portion 126 supported above the upper surfaces 25 of barriers 20 by downwardly projecting supports 127. As shown in FIG. 7a, an opening 128 communicates between the upper surface 129 of the rail portion and the lower end 131 of the support. A fastener or anchor 104, like its similarly numbered counterpart in FIG. 5, secures the barrier extension member 125 to the barriers 20. The barrier extension member 125 opens the view beyond the barrier to vehicle occupants while securing the barriers 20 against the type of rocking shown in FIG. 2, and while extending the height of the barrier to help prevent trucks or other vehicles of high center of gravity toppling over the barriers 20.

Figure 8:
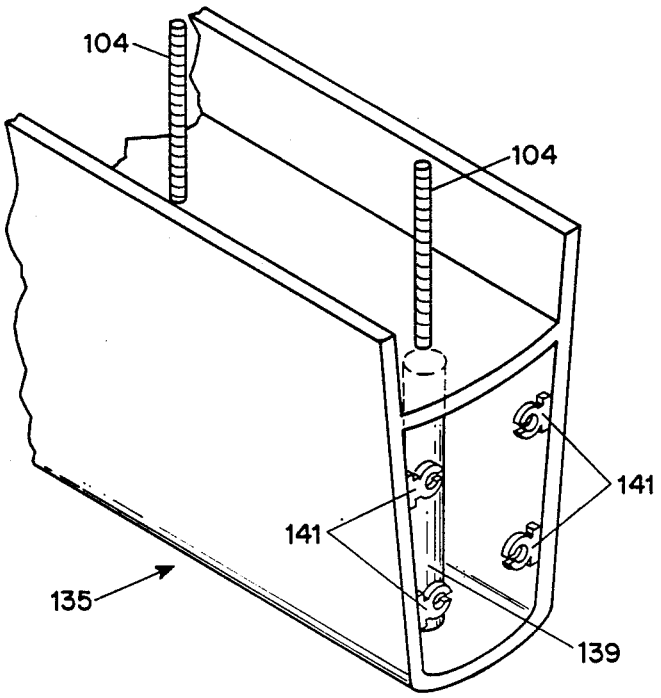
FIG. 8 is an enlarged cross-sectional view of an alternate embodiment of the barrier extension member and shows an outer hollow plastic part to be secured to a line of barriers.
Figure 9:
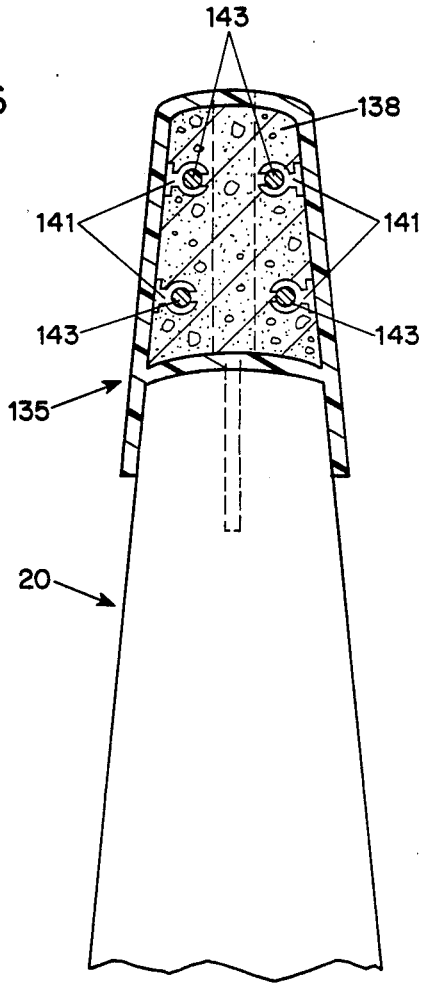
FIG. 9 another fragmentary perspective view showing a barrier extension like that of FIG. 8 and including a cast concrete core interior of the hollow plastic part.

FIG. 8 illustrates a hollow plastic extension member 135. Extruded of vinyl or other suitable plastic, the member has skirts 136 that fit downward along the sides of the barrier 20 as shown in FIG. 9. Fasteners 104, like those described with respect to FIGS. 5 and 7a, secure the plastic barrier extension members 135 in place. These members, utilized alone, provide glare protection, but not the additional strength that helps prevent vehicles toppling over the barriers or rocking of a barrier as shown in FIG. 2. The plastic members 135 can, however, constitute the mold for casting a concrete core within. Such a core 138 is shown in FIG. 9. For this purpose hollow tubes 139 are located within the member 135 during casting to accommodate extension of the connectors 104 therethrough after the core has been cast. For stressing the core, brackets 141 receive reinforcement rods 143. The brackets 141 can be integrally extruded along the length of the interior of the plastic extension member 135 or can be adhesively secured therein at points along the length of the member.

While specific preferred embodiments of the invention have been described, it will be appreciated by those skilled in the art that modifications therein can be made without departure from the spirit and scope of the invention as set out in the appended claims.

I claim:

1. A barrier system for roadways includes a cast concrete barrier member having a side to extend parallel to a road traffic lane, at least one recess defined in the side, a generally vertical opening from the recess to the bottom of the barrier, adapted to receive a fastener therethrough affixing the barrier to a supporting surface on which it rests, a cap having a lower projecting portion conforming to the recess and adapted to fit therein, and an upper reflector support means for projection outward of the recess and locating a reflector outward of the recess beyond the surface of the barrier and facing generally horizontally along the barrier to visibly identify the location of the barrier by reflection of light from vehicle headlights.

2. The barrier system of claim 1 wherein the cap has a widened, substantially flat central portion of sufficient area to entirely cover the recess, the lower projecting portion extending downward from the central portion to secure the cap in place with an undersurface of the central portion engaging the side of the barrier around the recess, and the upper reflector support means being located on the opposite side of the central portion from the lower portion, projecting from said central portion, and supporting said reflector above the central portion.

3. The barrier system of claim 1 wherein the barrier has a shoulder above which extends an upper portion of the barrier, the recess opening into the shoulder, and the reflector support means and reflector being located above the shoulder and laterally outward of the upper portion.

4. The barrier system of claim 2 wherein the reflector support means is an elongate member extending upward from the central portion and supporting the reflector on its side.

5. The barrier system of claim 4 wherein the elongate member is tubular, is adapted to stand substantially vertically with the lower projecting portion located in the barrier member recess.

6. The barrier system of claim 2 wherein the reflector support means is a low plastic projection supporting the reflector proximate the central portion of the cap.

7. The barrier system of claim 2 wherein the cap is of relatively easily severed plastic permitting easy removal of the cap for access to a fastener and removal of the barrier.

8. The barrier system of claim 2, wherein the lower projecting portion is hollow and flexible and open at the bottom thereof to conform frictionally within the recess.

9. The barrier system of claim 8, wherein the lower projecting portion is adhesively secured within the recess.

10. A barrier system for roadways includes a cast concrete barrier member having a side to extend parallel to a road traffic lane, at least one recess defined in the side, a generally vertical opening from the recess to the bottom of the barrier, adapted to receive a fastener therethrough affixing the barrier to a supporting surface on which it rests, sealing means for defining a seal about said fastener between the barrier bottom and the supporting surface, wherein the sealing means comprises a long, relatively soft, rope-like seal encircling the location of the fastener.

11. The barrier system according to claim 10 wherein said rope-like seal is located on the supporting surface proximate the periphery of the bottom of the barrier.

12. The barrier system according to claim 10 further comprising a hardening securing agent introduced into a hole in the supporting surface aligned with the generally vertical opening, said securing agent filling the interior of the location encircled by the seal.

13. The barrier system according to claim 11 wherein the barrier has a plurality of the generally vertical openings receiving a plurality of the fasteners, a hardening securing agent filling a plurality of holes in the supporting surface in alignment with the vertical openings in the barrier, the hardening securing agent filling the location interior of the seal in surrounding relation to the fastener portions extending through the recesses into the holes.

14. The barrier system according to claim 11, wherein the barrier system comprises a plurality of barrier members situated contiguously in end-to-end relation, and wherein the rope-like seal comprises two spaced-apart longitudinal parallel strips which are located one each along the two longitudinal peripheries of the contiguous barrier members, and a plurality of spaced-apart parallel cross-wise strips which intersect and connect the longitudinal strips, the cross-wise strips being located along each cross-wise periphery of each barrier member.

15. A barrier system including a plurality of cast concrete road barriers having sides for extending parallel to a traffic lane, end faces on the barriers for location proximate an adjoining end face of a neighboring barrier, a thin reflector having a supporting portion for location between the adjoining end faces of neighboring barriers, connecting means on the supporting portion for connection to one of the end faces, and a protruding reflector portion for extending outward from between the barriers beyond at least one of the barrier sides to reflect light from vehicle headlights.

16. The barrier system according to claim 15 wherein the connecting means on the supporting portion of the reflector comprises at least one opening in the supporting portion to receive fasteners secured to at least one of the barrier end faces.

17. A barrier system for roadways including a series of cast concrete barrier members located along a traffic lane end-to-end with end faces contiguous, a series of longitudinal barrier extension members located atop the series of barrier members, in contact with the barriers along the top thereof, and extending upward therefrom to substantially increase the barrier member height, and fastening means securing the extension members in place, said barrier extension members extending along the top of the barriers and across the contiguous end faces to secure together adjacent barriers, whereby the adjacent barriers are substantially less able to rock, one relative to the other, and expose an end face to an impinging vehicle.

18. The barrier system for roadways according to claim 17 wherein the extension members are of cast concrete having lower surfaces fitting onto the tops of the barriers, the system further comprising an elongate seal having a rib extending along its length and received between extension members and barriers to hold the seal in place.

19. The barrier system for roadways according to claim 18 wherein the elongate seal exposes a reflective outer surface thereon to traffic.

20. The barrier system for roadways according to claim 17 wherein the barrier extension member comprises a cast concrete core and plastic outer covering.

21. The barrier system for roadways according to claim 20 wherein the cast concrete core is cast within the outer plastic cover, and the cover includes means for locating reinforcing bars longitudinally therein.

22. The barrier system for roadways according to claim 17 further comprising a longitudinal glare prevention screen and means securing the glare prevention screen to the top of the barrier extension member.

23. The barrier system for roadways according to claim 22 wherein the means securing the glare prevention screen comprises an elongate channel formed longitudinally along the top of each barrier extension member, and an enlarged longitudinal bead on the bottom of the screen fit into and captive in the channel.

24. A barrier system for roadways including a series of cast concrete barrier members located along a traffic lane end-to-end with end faces contiguous, a series of barrier extension members located atop the series of barrier members and extending upward therefrom, and fastening means securing the extension members in place, said barrier extension members extending along the top of the barriers and across the contiguous end faces to secure together adjacent barriers, whereby the adjacent barriers are substantially less able to rock, one relative to the other, and expose an end face to an impinging vehicle, wherein the barrier extension members have an upper rail portion extending parallel to the series of barriers, and a plurality of downwardly projecting spaced apart supports, the supports having openings longitudinally therethrough and extending through the rail portion, enabling the introduction of an elongate fastener through the supports to the barrier below, and aligned openings in the top of the barrier receiving said fasteners, whereby a restraining system permitting visibility beyond the system is provided.

25. The barrier system for roadways according to claim 24 wherein the barrier extension members, including the rail portion and downwardly projecting supports are of cast concrete.

26. A barrier system for roadways including a series of cast concrete barrier members located along a traffic lane end-to-end with end faces contiguous, a series of barrier extension members adapted to locate atop the series of barrier members and extending upward therefrom, and fastening means for securing the extension members in place, said barrier extension members including a hollow plastic part with a lower portion conforming to and fitting on the tops of the barrier members.

27. The barrier system for roadways according to claim 26 wherein the hollow plastic part is a plastic outer covering for an elongate cast concrete core contained therein.

28. A cast concrete road barrier having at least one side for facing a traffic lane, a lower support surface, a top surface, and openings along the barrier length, through the entire height of the barrier, from the top surface to the lower supporting surface, said openings defining means for receiving upright posts securing the barrier in place, wherein the openings through the entire height of the barrier are of sufficient size and appropriate spacing to receive in-place steel beam uprights previously used to support metal barrier strip.

29. A barrier system for roadways including (a) a series of cast concrete barrier members located along a traffic lane end-to-end with end faces contiguous, (b) a series of cast concrete barrier extension members located atop the series of barrier members and extending upward therefrom, the extension members having lower surfaces fitting onto the tops of the barrier members, said extension members extending along the top of the barriers and across the contiguous end faces to secure together adjacent barriers, whereby the adjacent barriers are substantially less able to rock, one relative to the other, and expose an end face to an impinging vehicle, and said extension members being free of lateral openings along their length and providing glare protection between lanes of oppositely flowing traffic, (c) fastening means securing the extension members in place, and (d) an elongate seal having a rib extending along its length and received between extension members and barrier members to hold the seal in place.

30. A barrier system for roadways including a series of cast concrete members located along a traffic lane end-to-end with end faces contiguous, a series of barrier extension members located atop the series of barrier members and extending upward therefrom, and fastening means securing the extension members in place, said barrier extension members comprising a cast concrete core and plastic outer cover comprising a skirt fitting downward from the top of the barrier members along the sides of the barrier members, the extension members extending along the top of the barriers and across the contiguous end faces to secure together adjacent barriers, whereby the adjacent barriers are substantially less able to rock, one relative to the other, and expose an end face to an impinging vehicle.

* * * * *